United States Patent [19]

Mahr et al.

[11] Patent Number: 4,599,028

[45] Date of Patent: Jul. 8, 1986

[54] INSTALLATION FOR CHARGING A SHAFT FURNACE

[75] Inventors: René Mahr, Howald; Emile Lonardi, Bascharage, both of Luxembourg

[73] Assignee: Paul Wurth S.A., Luxembourg, Luxembourg

[21] Appl. No.: 306,950

[22] Filed: Sep. 30, 1981

[30] Foreign Application Priority Data

Oct. 10, 1980 [LU] Luxembourg ..... 82840

[51] Int. Cl.[4] ..... F27B 11/20

[52] U.S. Cl. ..... 414/206; 193/31 A; 266/176

[58] Field of Search ..... 414/160, 172, 199, 200, 414/205, 206, 208, 299, 300, 301; 193/31 R, 31 A, 32; 266/176, 183, 184

[56] References Cited

U.S. PATENT DOCUMENTS 3,724,689 4/1973 Sugawara et al. ..... 193/31 A X
3,732,994 5/1973 Yoshioka et al. ..... 414/205
3,963,128 6/1976 Voituriez et al. ..... 414/206 X

*Primary Examiner*—Robert G. Sheridan
*Attorney, Agent, or Firm*—Fishman & Dionne

[57] ABSTRACT

In a so-called bell less top type shaft furnace charging installation with rotary and angularly adjustable distribution chute (34) and one or more storage hoppers (18) which are offset with regard to the vertical central furnace axis, there are provided adjustable guide plates (44, 46, 146) in order to correct the path of material falling from the storage hopper(s) (18) on the chute (34).

12 Claims, 16 Drawing Figures

INSTALLATION FOR CHARGING A SHAFT FURNACE

Figure 1:
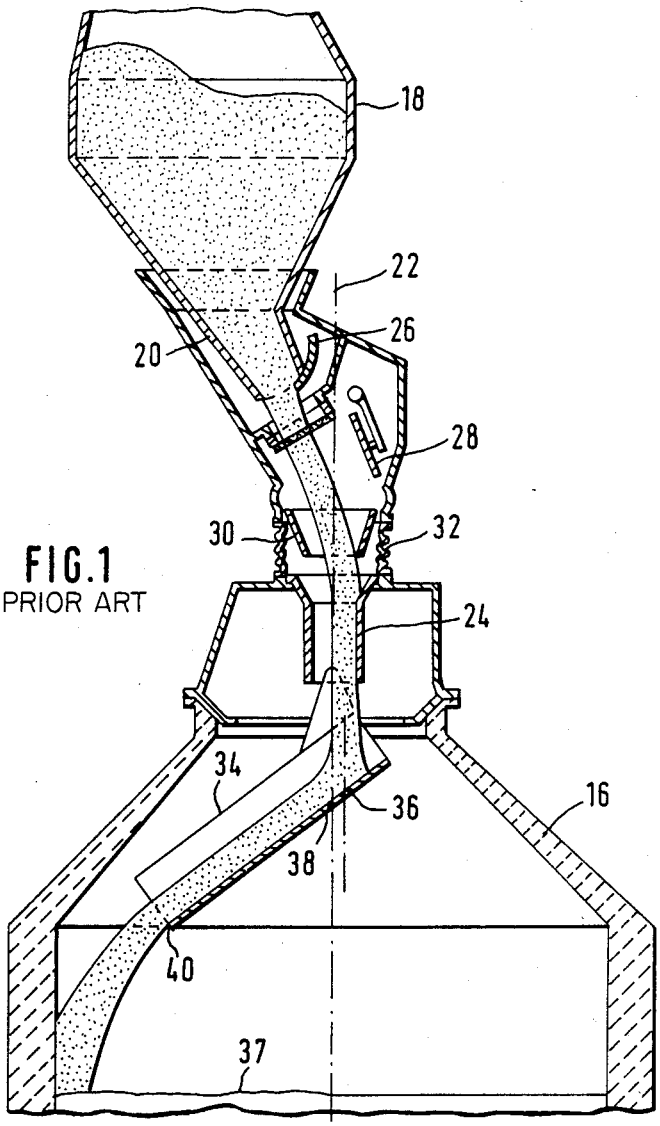
FIG.1 PRIOR ART

The present invention relates to the feed installations of shaft furnaces of the so-called "bell less top" type having no "cones" or "bells", comprising a rotary feed spout of which the angular position is adjustable and which is positioned "downstream" from a vertical feed channel, as well as one or two intermediate storage chambers positioned "upstream" from the feed channel and "staggered" in respect of the axis of this latter. The invention is in particular applicable to modern high-capacity blast furnaces with a high counter-pressure in the mouth.

The feed installations for blast furnaces operating without a cone are being adopted to an ever-increasing extent in place of the old installations which were provided with cones and of which the capacity limits have been surpassed as the large modern high-performance furnaces with their high counter-pressure have been developed. The feed installations such as described in the preamble are thus well known at the present time. Since they enable the material which is to be fed to the burden of the blast furnace to be distributed as desired, so that the furnace can be operated in the optimum manner, their principle is in itself faultless. It has been found, however, that the possibilities offered by this new charging device cannot be utilized to the full, owing to the absence of any control over the traject followed by the material to be fed in upstream from the spout. Since, in fact, as a result of the "staggered" positions of the intermediate storage chamber or chambers, the material follows a slanting traject from the outlet of the chamber to the feed channel, the material will not fall in accordance with the central axis of this channel but along the wall of the latter, on the side opposite to that corresponding to the chamber being emptied. The result of this "offset" fall of the material along the wall of the channel is that the point of impact of the material on the rear end of the spout will perform, for a given angle of inclination of the spout, a to-and-fro movement in respect of a mean point of impact during the rotation of the spout, this mean or intermediate point of impact being theoretically situated on the intersection of the axis of the furnace with the base of the spout. Now this base of the spout, forming a sliding path for the material to be fed to the furnace, is designed to reduce considerably the speed at which the material falls, i.e. the longer the traject over which the said material has to move on the base of the spout, the greater the braking effect to which it will be subjected. In other words, the material falling onto the spout downstream from the intermediate point of contact passes through the spout more quickly than that falling onto the latter upstream from the said point. The result of this situation is that distribution of the material on the burden on that of the wall of the feed channel along which the material slides will be different from the distribution taking place on the opposite side on the burden. This is tantamount to saying that the side or sides of the burden which are situated in the prolongation of the outlet axis of the chamber or chambers will receive more material than the sides opposite to this direction, with the consequent uneven distribution of the material on the burden and the attendant disadvantages where the satisfactory operation of the furnace is concerned.

A further obvious drawback of this known feed device is the rapid deterioration suffered by those portions of the feed channel which are subjected to the impact and friction of the jet of material, since this latter always acts on the same places of the side wall of the channel. Furthermore, the channel is difficult of access for dismantling and repair purposes.

The purpose of the present invention is to eliminate the aforementioned drawbacks by providing means for directing the fall of the material so that it takes place substantially in accordance with the central axis of the feed channel, so that the stresses to which the side wall of the latter is subjected will be reduced to a minimum and the point of impact of the material on the rear end of the spout will remain at one point, for a given pouring angle, throughout the rotation of the spout.

According to the present invention, there is provided a feed installation of blast furnace of the bell less top type comprising a rotary feed spout of which the angular position is adjustable and which is situated downstream from a vertical feed channel, as well as one or two intermediate storage chambers situated upstream from the feed channel and staggered in relation to the axis of this latter, wherein at least one adjustable guide blade is mounted between the chamber or chambers and the feed channel.

Further features and advantages of the present invention will emerge more clearly from the detailed description provided of a number of embodiments by reference to the accompanying drawings, which are as follows:

FIG. 1: a feed installation with spout, in accordance with the prior art, with one single chamber, the spout being turned in one particular direction.

Figure 2:
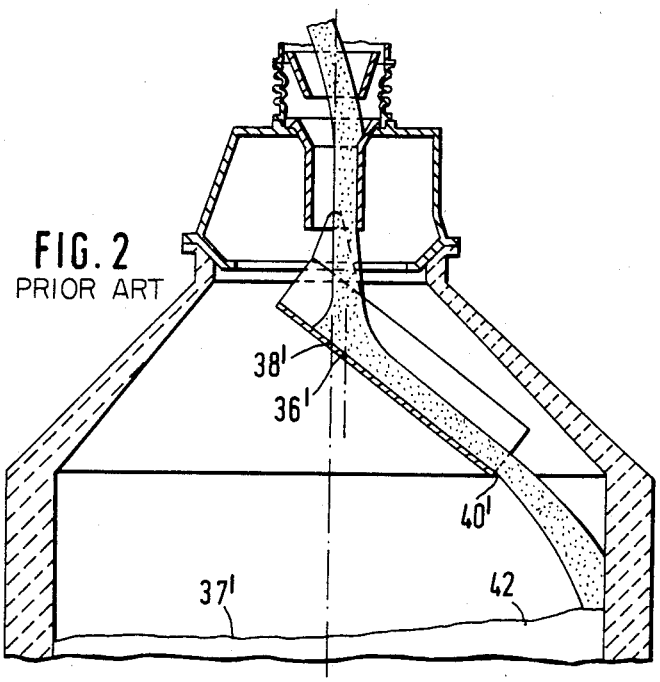
FIG. 2 PRIOR ART

FIG. 2: a part of the installation illustrated in the FIG. 1, the spout being turned in a second direction.

Figure 3:
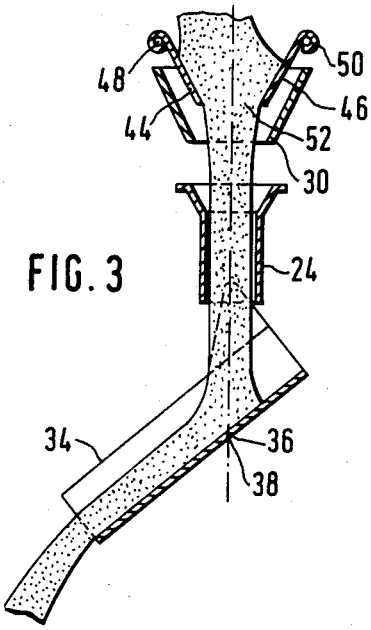
Figure 4:
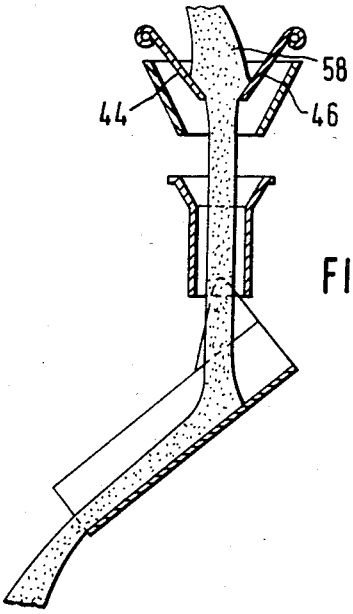
Figure 5:
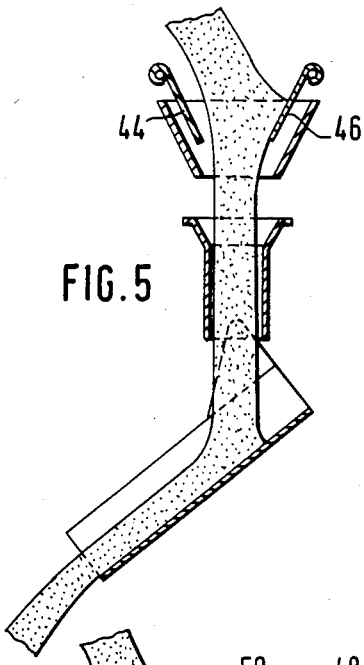
Figure 6:
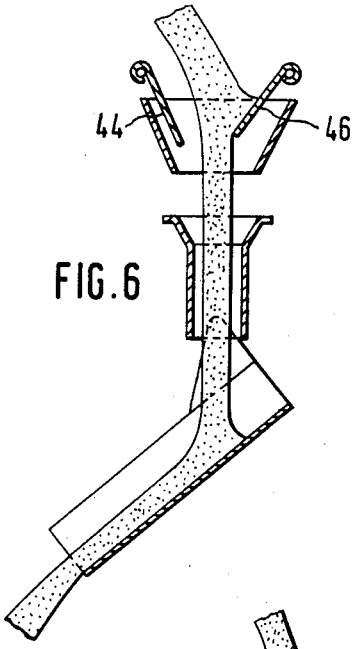

FIGS. 3–5: different positions of the adjustable blades, in the event of a first method of controlling these latter.

Figure 7:
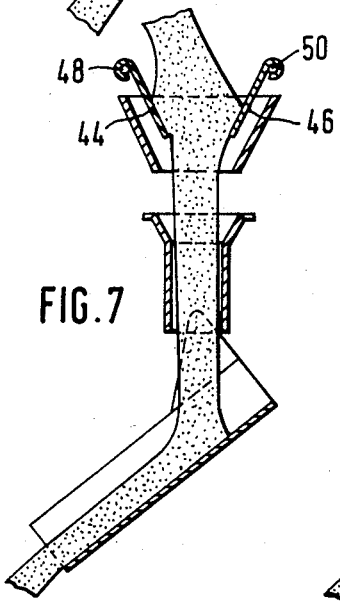
Figure 8:
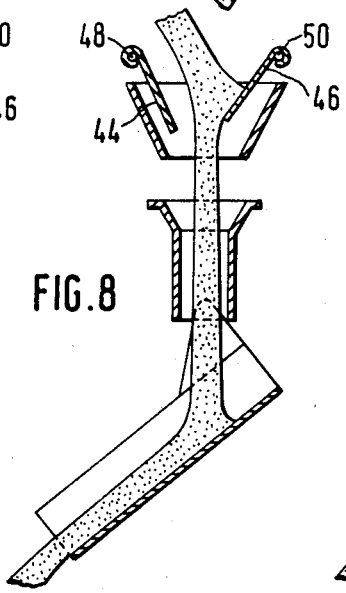
Figure 9:
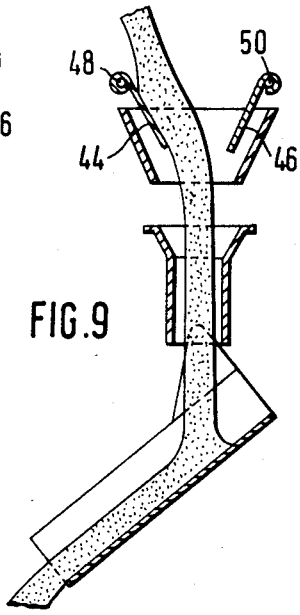
Figure 10:
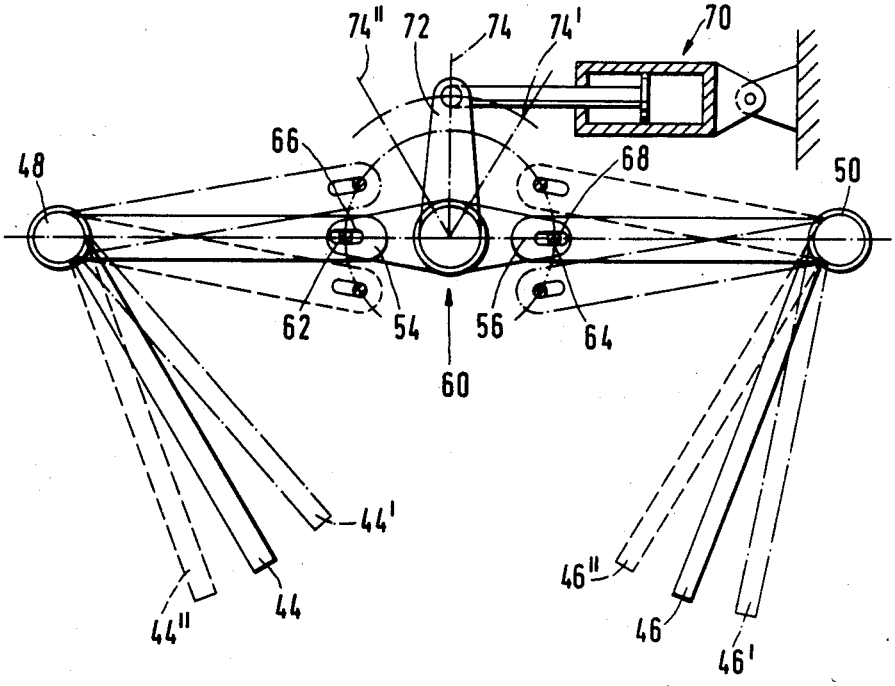

FIGS. 7–9: different positions of the adjustable blades, in a second method of controlling these latter FIG. 10: a schematic diagram of a constructional version for the drive of the adjustable blades.

Figure 11:
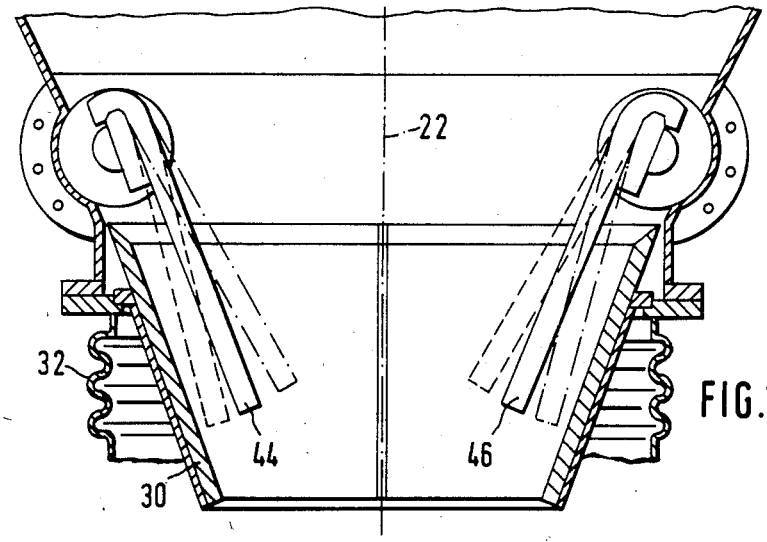

FIG. 11: a schematic elevation, partly in section, of the arrangement of the adjustable blades in the intermediate zone between the chamber or chambers and the feed channel.

Figure 12:
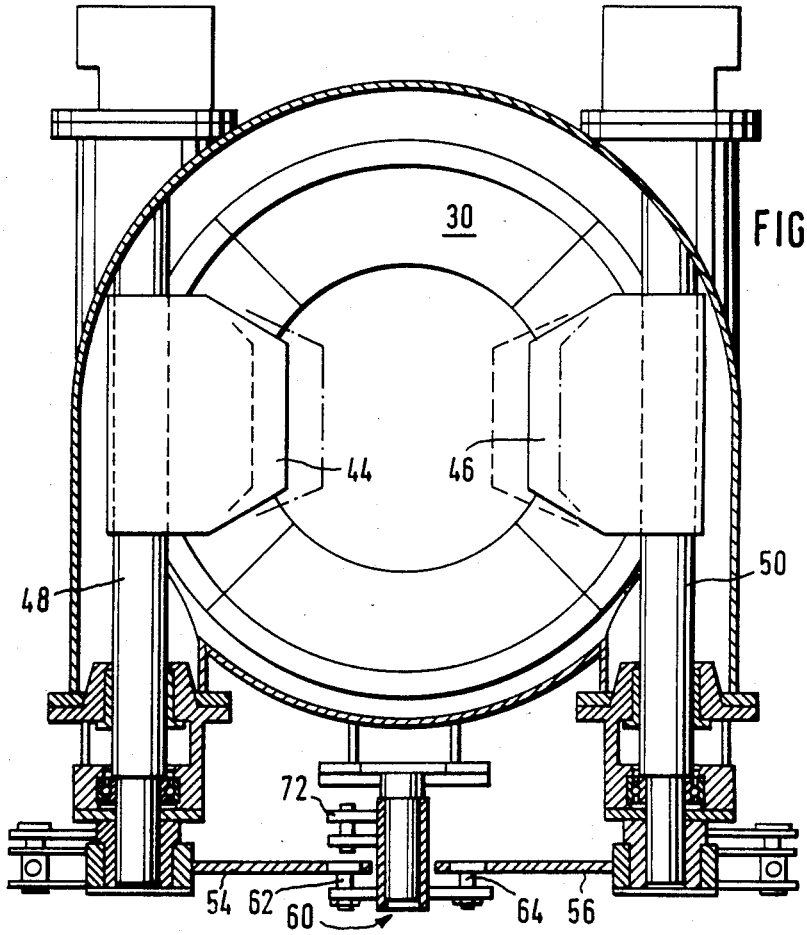

FIG. 12: a plan view corresponding to FIG. 11.

Figure 13:
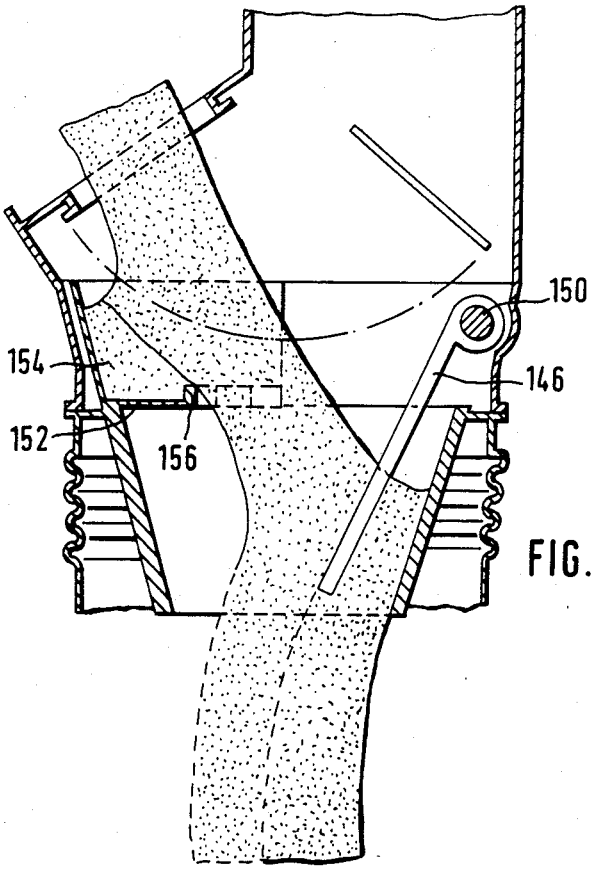

FIG. 13: a schematic vertical section through an embodiment of the invention having one single adjustable blade.

Figure 14:
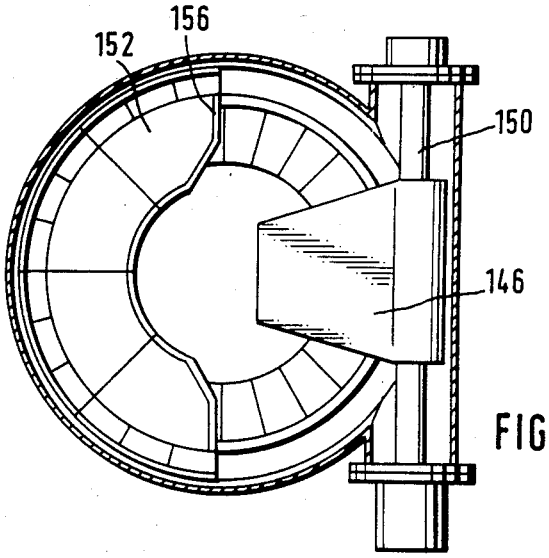

FIG. 14: a schematic plan view of the embodiment shown in FIG. 13.

Figure 15:
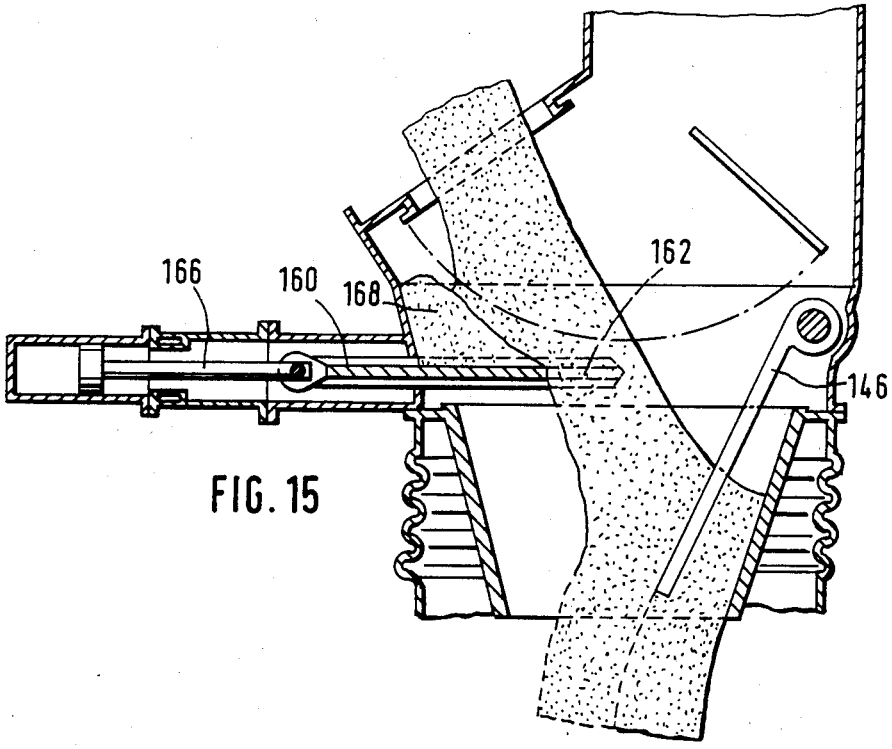
Figure 16:
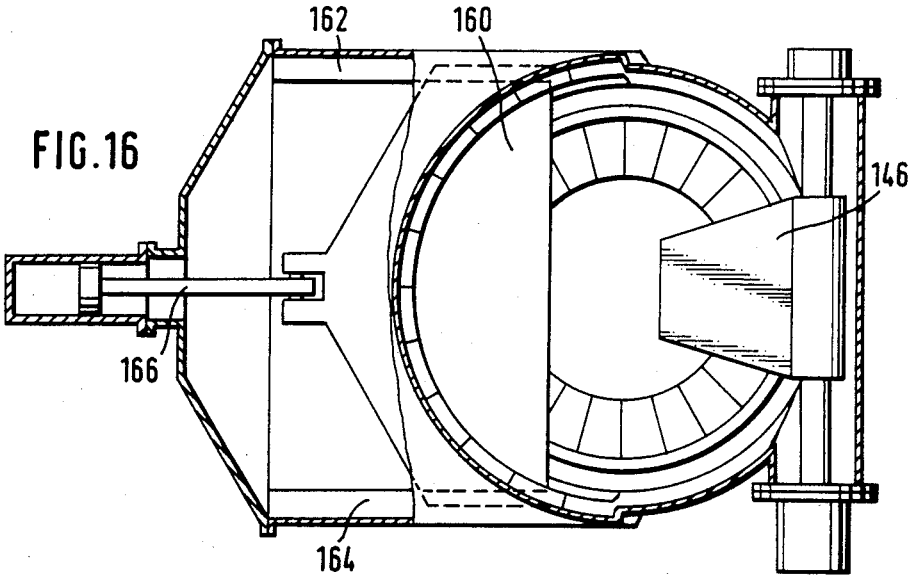

FIGS. 15–16: correspond to FIGS. 13 and 14 respectively and illustrate an improved variant of the embodiment indicated in these latter diagrams.

FIG. 1 shows the mouth of a shaft furnace, in this instance a blast furnace 16, equipped with a feed installation having a rotary spout in accordance with the prior art. This installation mainly consists of an intermediate storage chamber 18 with an outlet pipe 20, of which the axis is inclined in relation to the common axis 22 of the furnace and of the central feed channel. The outlet aperture of the pipe 20 can be regulated by means of a proportioning valve 26. When the latter is closed a shut-off valve 28 is closed in its turn in order to avoid a pressure loss in the furnace. A frustum-shaped intermediate rim 30 protects compensators 32 against impacts from the charging material falling from the outlet aperture of the chamber 18 to the central feed chamber 24 in the form of a funnel, of which the function will be seen in the diagram and consists of directing the flow of charging materials to the rear edge of the feed spout 34. This spout, of which the pouring angle can be varied, is shown in the position in which it pours the charging material onto the lefthand periphery of the furnace and of its burden 37. In this phase of the rotation of the spout about the axis of the furnace the point of impact 36 of the materials on the base of the spout is upstream from the point of intersection 38 between the axis of the furnace and the base of the spout. The traject to be covered by the material on the base of the spout, i.e. the distance between the points 36 and 40, is therefore greater in this case than the distance between the points 38 and 40, i.e. the distance between the point 38 of the intersection between the axis of the furnace and the base of the spout and the mouth of the spout. In this phase of the rotation of the spout, threfore, the materials are subjected to the maximum braking action on the rough base of the spout.

The opposite takes place in the position occupied by the rotating spout in FIG. 2. In this case the point of impact 36' of the materials on the base of the spout is downstream from the point 38' of the intersection between the axis of the furnace and the base of the spout. The traject to be covered by the material on the base of the spout, i.e. the distance between the points 36' and 40' is in this case smaller than the distance between the point 38' of the intersection between the axis of the furnace and the base of the spout and the mouth 40' of the spout. In this phase of the rotation of the spout, therefore, the materials are subjected to the minimum braking action on the rough base of the spout. It follows that in this position the spout conveys the charging material to a greater distance than in the position shown in FIG. 1, resulting in an accumulation 42 of material on the burden on this side of the furnace, i.e. on the right-hand side as seen in FIG. 2.

In the case of two chambers, one on each side of the axis of the furnace (not shown in the drawing), there would likewise be an accumulation of material (again not shown) on the left-hand side (still in accordance with FIG. 2) of the burden. A minimum deposit of materials would then take place in front or behind the plane of the drawing.

In order to avoid such uneven deposits of material on the burden and the resulting disadvantages for the satisfactory operation of the furnace and also in order to reduce to the minimum the wear resulting from the impacts and friction of the material against the walls of the feed channel, a first embodiment of the invention comprises adjustable blades between the chamber or chambers and the feed channel. FIGS. 3–9 show these guide blades 44 and 46 positioned a slight distance upstream from the frustum-shaped protection rim 30 and mounted by one of their ends on driving shafts 48 and 50 respectively.

The invention provides in principle for two different methods of actuating the driving shafts 48 and 50.

In a first version (not shown) the two shafts are separately controlled so that they can rotate independently of each other, both as regards the direction and the amplitude of the rotation.

In a second version, which will be described in greater detail by reference to FIG. 10, the two shafts are interconnected by a suitable mechanism in order to cause them to rotate in one and the same direction.

It is obvious that the first version is more flexible in its applications than the second, whereas this latter offers the advantage of being simpler in its operation.

FIGS. 3–6 show different operating phases of the first method of actuating the driving shafts 48 and 50, serving to cause the guide blades 44 and 46 to pivot independently. In FIG. 3 a considerable flow of material 52 is poured out of the chamber or chambers (not shown in the drawing) towards the spout 34 via the adjustable blades 44 and 46, the protection rim 30 and the central feed channel 24. A considerable volume of material, such as that shown in this FIG. 3, is required when substances relatively light in weight have to be fed to the furnace, such as coke, by comparison with substances which are relatively heavy, such as ore (see FIG. 4). If the position of the blades 44 and 46 in the two FIGS. 3 and 4 are compared it will be found that their angle of inclination in respect of the axis of the furnace (i.e. of the feed channel 24) has been adapted to the flow of material 52 and 58 inasmuch as in the case of the lower rate of delivery 58 the aperture giving passage between the blades has been reduced in comparison to the passage provided between them in FIG. 3. This narrowing of the aperture, or rather the change in the shape of the cross section of the flow of material in accordance with FIG. 4, has been brought about, as may be seen from a comparison between these two diagrams, by causing the shafts 48 and 50 to rotate in the opposite direction.

FIGS. 3 and 4 thus show an application of the first method of driving the shafts, in which method the angle of inclination of the adjustable blades may be selected in accordance with the rate of delivery of the material with which the furnace is to be charged, while at the same time ensuring that the material will fall centrally through the feed channel 24. As a result of this central fall the point of impact 36 of the material on the rear part of the spout coincides with the point 38, the point of intersection between the axis of the furnace (and the channel 24) and the base of the spout. In other words, if the material is caused to fall centrally, by the aid of the adjustable blades, it will have the same traject to cover on the base of the spout for all the phases of the latter's rotation. This means, in accordance with the explanations given in the foregoing, that all the zones of the burden will receive the same quantity of material for a given angle of inclination of the spout. The central fall of the material through the channel 24, as ensured by the present invention, can likewise be relied upon to take place in the alternative positions shown for the blades in FIGS. 5–9.

Among these FIGS. 5–9, FIGS. 5 and 6 again show the method of positioning the blades independently, with the one difference, in respect of FIGS. 3 and 4, that it is now sufficient to use one single blade, i.e. 46, to deflect the flow of material or to centralize either a large flow (FIG. 5) or a smaller flow (FIG. 6) of material to be fed to the furnace.

Finally, FIGS. 7–9 provide schematic diagrams of the operation of the two guide blade according to the second method of control, in which the blades are tilted simultaneously by causing the two shafts 48 and 50, interconnected by a suitable mechanism, to rotate in one and the same direction. In FIG. 7 the two blades are situated at substantially the same angle of inclination (reversed) in respect of the axis of the furnace, while in FIG. 6 the shafts 48 and 50 have been simultaneously rotated in a clockwise direction, whereas in FIG. 9 they have been rotated in the opposite direction, again in relation to their position in FIG. 7.

These FIGS. 7–9 thus show that the second method of controlling the blades likewise makes it possible to ensure that the material will fall centrally, by pivoting the said blades simultaneously in one direction or the other in accordance with the delivery of material and/or its traject (c.f. FIGS. 8 and 9).

FIG. 10 shows a constructional version for the operation of the blades by the second method, i.e. that in which the blades are interconnected by suitable mechanism in order to set up a simultaneous movement of the blades in the same direction of rotation as the shafts 48 and 50. For this purpose levers 54 and 56, integral with the shafts 48 and 50 respectively, are actuated by a central lever 60 via pivots 62 and 64 on the levers 60 and oblong holes 66 and 68 in the levers 54 and 56, interacting with the pivots 62 and 64. The central lever 60 itself is actuated by a servo-motor, such as a hydraulic jack 70 via another control lever 72 acting on the shaft of the central lever 60. This FIG. 10 shows different positions 44 and 46, then 44' and 46', and finally 44" and 46", for the blades and levers 54 and 56, these positions being shown in full lines, broken lines and dot-and-dash lines respectively. The resulting angle of inclination between the control lever 72 and the vertical for these different positions of the blades is symbolized by the median lines 74, 74' and 74" respectively.

FIGS. 11 and 12 are an elevation and a plan view, respectively, of the practical integration of the device shown in FIG. 10 into the furnace feed system. A comparison between the different diagrams (see also FIG. 1) will be rendered easier by the use of one and the same reference number for any item occuring in more than one of them. As may be seen, for example, the blades 44 and 46 are situated, over the greater part of their length, along inner walls of the protective rim 30. The shafts 48 and 50 to which the blades 44 and 46 are attached are situated upstream from the rim 30, at a point easily accessible for the purpose of replacing the blades when their state of wear so requires. It should be noted that in FIG. 12 the jack 70 of FIG. 10 is not shown and the control lever 72 has been turned through an angle of about 90°.

The two blades 44 and 46 could be replaced by four blades arranged crosswise in opposite pairs.

FIGS. 13 to 16 show two embodiments of the invention with one single guide blade and thus more particularly suitable for feed installations having one single intermediate storage chamber.

In the first embodiment, illustrated in FIGS. 13 and 14, an adjustable blade 146 is borne by a pivot shaft 150 and operates in the same manner as the blades 46 described in the foregoing.

On the other hand, the second plate 44 described farther back is replaced, in the embodiment shown in FIGS. 13 and 14, by a fixed plate 152, substantially horizontal, in order to intercept, at least partially, the falling material to be fed to the furnace. As in the example shown, this plate may be of semi-annular shape, in order to retain a natural slope, forming "material-to-material caissons". The formation of this slope may be assisted by the presence of an internal edge 156. The purpose of this slope 154, as is well known, is to reduce the wear on the plate 152, since the impact of the falling material occurs on the side of the slope 154 instead of on the latter itself.

The purpose of the plate 152 is thus to slow up the fall of material and deflect it to the plate 146, which latter, when correctly orientated, ensures that the traject of the falling material will be deflected to the desired place in the spout, not shown in the drawing, in the same manner as described in conjunction with the preceding diagrams.

Although FIG. 13 shows the material being poured from a chamber situated to the left of the axis, the same system will be suitable in the case of material poured from a chamber situated on the right, always provided that the blade 146 is orientated in accordance with this arrangement.

FIGS. 15 and 16 show another embodiment, which, in fact, is an improved variant of the version illustrated in FIGS. 13 and 14, inasmuch as the fixed plate 152 has been replaced by a sliding plate 160. The adjustable blade 146 is secured in the same way and exerts the same functions as in the version shown in FIGS. 13 and 14.

The plate 168 slides in a pair of side rails 162, 164, under the action of a control rod 166 actuated by a suitable motor, such as an electric, hydraulic or pneumatic motor etc. The function of plate 162 is similar to that of the plate 152. The plate 162 however, offers the advantage of being adaptable in its position to the flow of material, i.e. to the physical properties and to the actual nature of the material being poured, in order to cause the latter, by interaction with the adjustable blade 146, to follow an ideal path of fall.

It should also be noted that the slope 168, retained by the plate 160 and forming a "material-to-material caisson", can be completely removed by withdrawing the plate 160 altogether.

Finally, it should be emphasized that it is not only possible for the plate 160 to be of the same shape as the plate 152 but that the two plates may have different shapes from those shown in the drawings.

Although the invention can be applied to all furnaces of which the distribution system comprises a rotary spout it proves particularly advantageous when the furnace only has one single storage chamber, as in the case of the device forming the subject of British patent application 2 038 463 A.

Finally, emphasis must be placed on the fact that the foregoing description serves merely to illustrate the invention. Numerous modifications could be made thereto without departing from the scope of the invention. In one advantageous variant, in particular, the mechanism shown in FIG. 10 and serving to actuate the blades by levers with pivote sliding in oblong holes is replaced by a gearing mechanism in which the ends of the levers are provided with toothed sectors interacting with a central pinion integral with the control lever 72.

We claim:

1. A charging installation for a shaft furnace having at least one storage chamber for material to be fed to the shaft furnace, the storage chamber having a vertical axis offset relative to the vertical axis of the shaft furnace, including:

rotating spout means for receiving material from said storage chamber and distributing said material to the shaft furnace; and guide blade means upstream of said spout means and between the storage chamber and said spout means to control the fall of material from the storage chamber to said rotating spout about a predetermined axis.

2. A charging installation for a shaft furnace as in claim 1 including:

means for adjusting said guide blade means to control the fall of material.

3. A charging installation for a shaft furnace as in claim 1 wherein said guide blade means includes:

first and second guide blades positioned symmetrically with respect to a vertical axis.

4. A charging installation for a shaft furnace as in claim 3 including:

adjusting means for adjusting each of said first and second guide blade means.

5. A charging installation for a shaft furnace as in claim 4 wherein said adjusting means includes:

first rotatable shaft means on which said first guide blade means is mounted;

second rotatable shaft means on which said second guide blade means is mounted; and actuating means for rotating each of said first and second shaft means.

6. A charging installation for a shaft furnace as in claim 5 wherein said actuating means includes:

first lever means connected to said first shaft means;

means lever means connected to said second shaft means; and power means connected to said first and second lever means to actuate said first and second guide blades simultaneously.

7. A charging installation for a shaft furnace as in claim 5 wherein said actuating means includes:

first lever means connected to said first shaft means;

second lever means connected to said second shaft means; and power means connected to said first and second lever means to actuate said first and second guide blades simultaneously in opposite directions relative to said vertical axis.

8. A charging installation for a shaft furnace as in claim 1 including:

plate means cooperating with said guide blade means to control the fall of material to said spout means.

9. A charging installation for a shaft furnace as in claim 8 wherein:

said plate means and said guide blade means are spaced apart about a vertical axis.

10. A charging installation for a shaft furnace as in claim 9 including:

means for pivotally adjusting the position of said guide blade means.

11. A charging installation for a shaft furnace as in claim 10 including:

means for slidably adjusting the position of said plate means.

12. A charging installation for a shaft furnace as in any of claims 1–11, including:

feed channel means between said guide blade means and said spout means.

* * * * *